US006055777A

United States Patent [19]

Rekioja

[11] Patent Number: 6,055,777

[45] Date of Patent: May 2, 2000

[54] OPENING AND CLOSING DEVICE FOR DOOR

[75] Inventor: Markku Rekioja, Huittinen, Finland

[73] Assignee: Berendsen PMC OY AB, Vantaa, Finland

[21] Appl. No.: 08/859,224

[22] Filed: May 19, 1997

Related U.S. Application Data

[63] Continuation of application No. 08/545,794, filed as application No. PCT/FI94/00181, May 10, 1994, abandoned.

[30] Foreign Application Priority Data

May 11, 1993 [FI] Finland ..... 930280 U

[51] Int. Cl.[7] ..... E05F 11/00

[52] U.S. Cl. ..... 49/360

[58] Field of Search ..... 49/360, 116, 118, 49/119, 120

[56] References Cited

U.S. PATENT DOCUMENTS

| | | | |
|---|---|---|---|
| 1,260,773 | 3/1918 | Holcomb | 49/360 X |
| 3,455,058 | 7/1969 | Hewitt | 49/360 X |
| 3,802,123 | 4/1974 | Frey et al. | 49/360 X |
| 3,921,335 | 11/1975 | Hewitt et al. | 49/360 X |
| 3,938,282 | 2/1976 | Goyal | 49/360 X |

FOREIGN PATENT DOCUMENTS

| | | | |
|---|---|---|---|
| 786209 | 5/1968 | Canada | 49/360 |
| 345457 | 1/1940 | France | 49/360 |
| 1906629 | 8/1970 | Germany | 49/360 |
| 2624934 | 12/1977 | Germany . | |
| 167691 | 2/1934 | Switzerland | 49/360 |
| 411616 | 11/1966 | Switzerland . | |

*Primary Examiner*—Jerry Redman
*Attorney, Agent, or Firm*—Larson & Taylor

[57] ABSTRACT

An assembly system for a medium powered door opening and closing device especially for sliding doors. The assembly consists of a supporting profile located above the doorway with grooves or corresponding guides which act as travel tracks for rollers or wheels that function as door suspending members. The assembly also includes one or more channels through the profile to conduct pressure medium to a cylinder and/or a valve system and a cylinder to move the door, which cylinder is placed parallel to and in association with the profile. There is at least one connection hole between a profile flow channel and the cylinder for moving the piston and the piston rod. The cylinder is connected to supporting members and a valve system to control the cylinder.

4 Claims, 2 Drawing Sheets

OPENING AND CLOSING DEVICE FOR DOOR

This application is a continuation of application Ser. No. 08/545,794 filed Nov. 9, 1995 now abandoned. Parent Application Ser. No. 08/545,794 was International Application PCT/FI94/00181.

BACKGROUND OF THE INVENTION

1. Field of the Invention

The invention relates to an assembly of a door opening and closing device where an actuator, a supporting rail and a control valve are combined into one unit.

2. Description of the Prior Art

Previously, pneumatically operated doors known also as sliding doors, used a pneumatic cylinder to produce the linear motion required for door opening. The door has been moved sidewards and supported by many different suspension means. In most cases rollers or wheels have been used both at the upper and lower door edges of the door. For rollers or wheels there are rails or other similar guides to force the door to keep its direction and height level. The cylinder is coupled either directly to the door or to the door suspensions and compressed air is fed to the cylinder along a separate piping and the control valve is a separate component in the feed line of the compressed air.

In these solutions the door supporting and guiding rails are installed separately. The cylinder fixing means as well as the valve must be installed in a suitable place in the wall and, further, the compressed-air hoses must be connected separately to the cylinder. Such a solution means time-consuming installation and the final appearance of the device is not very representative. Generally, the device has to be fully covered.

By means of the assembly as per this invention a decisive improvement of these disadvantages is achieved and the invention is characterized in what is presented in the enclosed description.

SUMMARY OF THE INVENTION

The primary advantage of the assembly as per this invention is easy installation above the doorway. The cylinder, valve and supporting rail are mounted together, since the cylinder and the valve are already prefitted in the supporting rail. Even the compressed air piping is, for the most part made beforehand by using the components of the assembly to conduct compressed air. The final form of the assembly is a good looking, not much space taking oblong rail that does not necessarily need any covering.

In the following the invention is illustrated in detail with reference to the enclosed drawings.

DETAILED DESCRIPTION OF THE PREFERRED EMBODIMENTS

Figures 1, 2A:
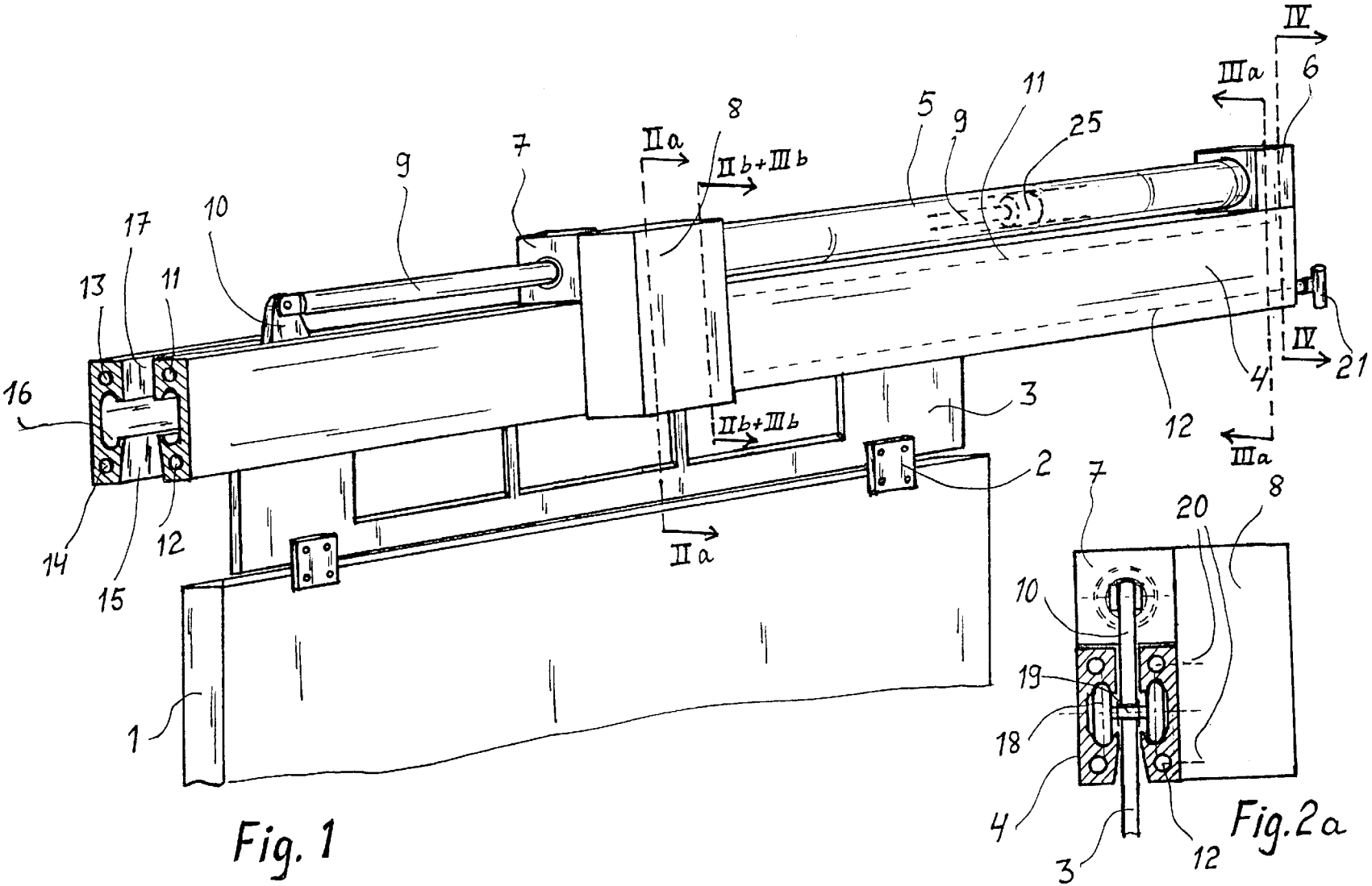
FIG. 1 is a diagonal side projection of the assembly.
FIG. 2*a* is a cross-section along line IIa—IIa of FIG. 1 of the assembly with the rail viewed from one end.

Figure one shows an embodiment of the assembly of the invention where door 1 is a sidewards sliding door. The supporting profile 4 is fixed to the wall above the doorway. The supporting profile 4 has grooves 16 for roller series 18, of which there are 2 sets, one in each end of the suspension member 3. A set of roller series 18 contains 3 pairs of rollers 16 in each end of suspension member 3, two fixed pairs and one adjustable pair. By adjustment the rollers are kept vertically free from backlash. The suspension member 3 is a rigid plate. Door 1 is suspended from part 3 by brackets 2. Supporting profile 4 is most advantageously made of anodized aluminum and its lower part is an open design throughout the profile 4. The upper profile part is an open design 17 only as much as the upper part of suspension member 3 travels moved by piston rod 9. In the profile corner areas there are channels 11–14, which are formed in connection with the extrusion of the profile 4. Accordingly, the channels run throughout the profile. The door-moving pneumatic cylinder 5 is directly fixed on the supporting profile 4. The cylinder ends 6 and 7 are fastened directly to supporting profile 4. Thereby, the cylinder has no conventional binding bolts for interconnection of the ends. Ends 6 and 7 are connected to the rail so that in the rail flow channel 11 there are drill holes at ends 6 and 7. The drill hole is made either as a connection or packed by some other means so that compressed air from channel 11 will enter ends 6 and 7 without any leaks. Channel 11 is closed at valves 8 in order to produce separate flow channels from valves 8 to ends 6 and 7. Compressed air is fed to valve 8 through channel 12 from connection 21 in the end of side of supporting profile 4. Valves 8 are electrically controlled and the door safety system with its double-acting pressure-difference switch and travel limits is also electrically powered.

Figure 2B:
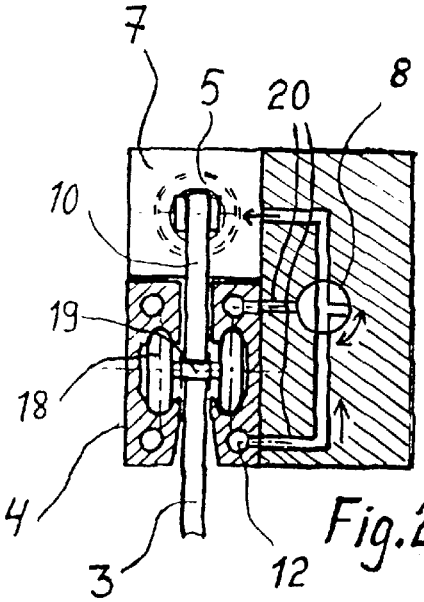
FIG. 2*b* is a cross-section along line IIb—IIb of FIG. 1 of the assembly with the rail viewed from one end.
Figure 4:
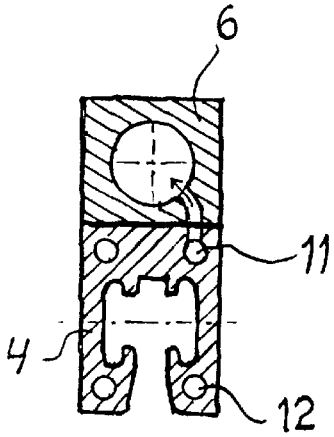
FIG. 4 is a cross-section view along line IV—IV of FIG. 1 of the rear end of the cylinder and the profile showing air conduction from the channel to the cylinder end.

FIG. 2 shows the assembly from one end. Roller series 18 is accurately in its grooves and the rolls joined by axle 19. Valves 8 are connected by ports 20 to channel 11 and channel 12. Pressure is conducted by valves 8 either to front or rear of the piston in the cylinder. The cylinder placed on supporting profile 4 can also be aluminum profile or similar, whereat it contains also channels parallel to the cylinder.

Figure 3A:
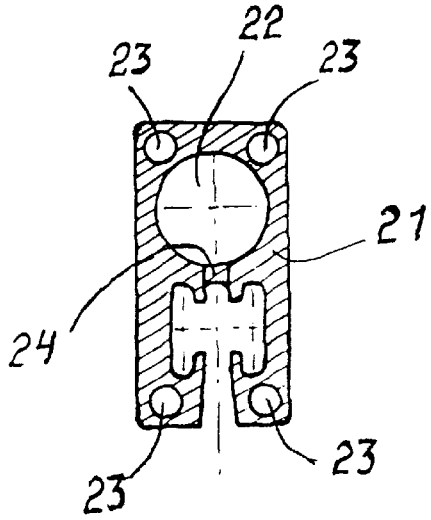
FIG. 3*a* is cross-section along line IIIa—IIIa of FIG. 1 showing the profile.
Figure 3B:
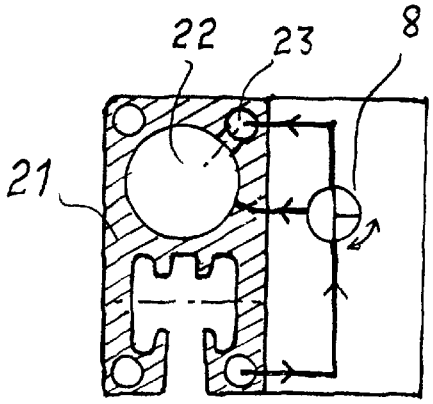
FIG. 3*b* is a cross-section along line IIIb—IIIb of FIG. 1 showing the profile and the air conduction system.

FIG. 3 shows a cross-section of profile 4, into which profile 4 a cylinder 22 has been formed, wherein a door moving piston travels by pressure medium. In channels formed in profile 4 the pressure medium is conducted at least from the valve to cylinder 22. If needed, the feed pressure can be led along channels 23 to the valve. The upper channels are easily connected with drill holes at necessary points to cylinder space 22. The motion of the piston in cylinder 22 is transmitted through opening 24 most advantageously from the piston rod to supporting rollers in profile lower part. In cylinder 22 there can be only a piston without a rod, whereby the motion of piston is conducted to the supporting rollers through the packed opening 24.

As other embodiments of the invention, the location of valves 8 also as extensions in the rail end can be presented, whereby compressed air is conducted, for instance, along flow channel 11 to end 6 and along channel 13 to end 17. In such a case, the valve can be closed both at the rail end and the end 6. Also several other connection combinations of flow channels to the ends and to the valves are possible within the inventive concept. Naturally, instead of sliding doors the assembly can also be connected or installed to other doors and hatches.

I claim:

1. An assembly having a medium powered sliding door opening and closing device the assembly comprising a supporting profile located above a doorway and the profile having travel tracks with rollers and a cylinder having a piston located therein, the piston is provided with a piston rod for moving the door by means of a pressure medium, the improvement comprising:

the supporting profile having a least one flow channel formed inside of, and parallel to, said supporting profile conducting pressure medium to the cylinder;

a connection hole from said at least one flow channel to said cylinder supplying pressure medium to move the piston inside said cylinder;

a door supporting member connected to said piston rod of said cylinder; and a valve system connected to said at least one flow channel controlling flow of said pressure medium to said cylinder.

2. An assembly according to claim 1 wherein said valve system forms a side of the supporting profile and is connected to flow channels in the supporting profile by means of holes in the side of the supporting profile.

3. An assembly according to claim 1 wherein the valve system is located in an end of the supporting profile and connected to the flow channels which are parallel to the supporting profile.

4. An assembly according to claim 1 wherein the cylinder is formed inside the supporting profile and parallel to the supporting profile.

* * * * *